US008377151B2

(12) United States Patent
McMurry et al.

(10) Patent No.: US 8,377,151 B2
(45) **Date of Patent: *Feb. 19, 2013**

(54) PROCESS FOR PRODUCING A RENEWABLE BIOFUEL FROM WASTE WATER TREATMENT PLANTS

(76) Inventors: Zackery Allen McMurry, Mishawaka, IN (US); James Casey Smoot, West Sacramento, CA (US)

( * ) Notice: Subject to any disclaimer, the term of this patent is extended or adjusted under 35 U.S.C. 154(b) by 364 days.

This patent is subject to a terminal disclaimer.

(21) Appl. No.: 12/590,120

(22) Filed: Nov. 2, 2009

(65) Prior Publication Data

US 2010/0055628 A1 Mar. 4, 2010

Related U.S. Application Data

(63) Continuation-in-part of application No. 11/824,967, filed on Jul. 3, 2007, now Pat. No. 7,641,706.

(60) Provisional application No. 61/197,923, filed on Nov. 1, 2008, provisional application No. 60/832,232, filed on Jul. 19, 2006.

(51) Int. Cl.
*C10L 1/00* (2006.01)
*C10L 1/18* (2006.01)

(52) U.S. Cl. ..... 44/307; 431/1; 44/308; 44/385; 44/389

(58) Field of Classification Search ..... 44/307–308, 44/385, 389; 431/1
See application file for complete search history.

(56) References Cited

U.S. PATENT DOCUMENTS

| | | | | |
|---|---|---|---|---|
| 5,107,016 | A * | 4/1992 | Pennetreau | 560/179 |
| 6,083,729 | A * | 7/2000 | Martin et al. | 435/135 |
| 7,641,706 | B1 * | 1/2010 | McMurry et al. | 44/307 |
| 2005/0112735 | A1 * | 5/2005 | Zappi et al. | 435/134 |
| 2005/0239182 | A1 * | 10/2005 | Berzin | 435/166 |

* cited by examiner

*Primary Examiner* — Pamela H Weiss
(74) *Attorney, Agent, or Firm* — Albert W Davis, Jr.

(57) ABSTRACT

The present invention describes a method for production of a renewable, combustible liquid fuel that may be used; in internal combustion engines, as a fuel source for electricity generation including turbines and fuel cells, or as a burnable heat source. This fuel is derived from set of biomolecules that are produced under nutrient limitation conditions as those found at a waste water treatment plant. More specifically this invention envisions the use of poly(3-hydroxyalkanoates) (PHA), especially those with monomeric residues ranging in size from C4 to C10, as a feed stream for production of a biofuel.

35 Claims, No Drawings

PROCESS FOR PRODUCING A RENEWABLE BIOFUEL FROM WASTE WATER TREATMENT PLANTS

CROSS REFERENCE TO RELATED APPLICATIONS

This patent application is a continuation-in-part of non-provisional patent application Ser. No. 11/824,967 filed Jul. 3, 2007 which is now U.S. Pat. No. 7,641,706 issued Jan. 5, 2010 which relates to provisional patent application Ser. No. 60/832,232 filed Jul. 19, 2006 and is related to provisional patent application Ser. No. 61/197,923 filed Nov. 1, 2008.

BACKGROUND OF INVENTION

This present invention relates generally to the field of alternative fuels and more particularly the conversion of cellular biomass to combustible liquid fuels. Currently much work has been done to generate PHA (poly(3-hydroxyalkanoate)) molecules using recombinant bacteria. Work has been done to isolate and identify genes to produce PHAs for use in medical devices or use as a biodegradable plastic in consumer products. There is also a body of work describing the use of transgenic plants to produce PHAs for use in biodegradable plastics. Moreover, several studies demonstrating PHA production by mixed microbial communities fed a variety of complex feedstocks under a variety of cultivation conditions were performed. The presented invention relates to the use of mixed microbial communities to produce several related bio-products that are derived from PHA molecules and some of which may be used as a biofuel.

Currently much effort in the alternative fuel sector is directed at making ethanol production an economical alternative to standard gasoline and diesel fuels. Previous work done in this field have been related to the use of biomass to produce ethanol or mixtures of varying alcohol compounds. Some work has been done to derive ethanol from readily available sources such as municipal waste streams. There has also been advancement in the field of novel alternative fuels from renewable sources. This has been done in municipal waste systems where native cellulose has been isolated and then is further converted into varying lengths of hydrocarbons. However, this composition of products is highly variable and depends greatly upon the waste stream obtained from the municipal waste. Currently, waste water treatment plants (WWTPs) recover energy from influent waste streams by generating electricity and heat from by-products of the wastewater treatment methodes by burning biogas. Biogas is a mixed gas byproduct (primarily methane and carbon dioxide) of anaerobic sludge digestion. In addition, production of biodiesel from components of WWTP influent was patented.

This process would allow an alternate method for energy production at WWTPs by production of a mixed liquid biofuel containing low boiling point distillate fraction including alcohol derivatives of alkenoates, hydroxyalkanoates, alkoxyalkanoates, and high boiling point distillate fractions including hydroxy-fatty acids, oligomers of ethyl 3-hydroxyalkanoates, and saturated as well as unsaturated fatty acids. It is generally recognized that the composition of the mixed liquid biofuel will vary with type of alcohol, reaction conditions, microbial community composition, fermentation conditions, and feedstock sources.

BRIEF DESCRIPTION OF THE INVENTION

The present invention relates to several methods for production of a renewable liquid fuel. The fuel being produced is derived from a group of biomolecules produced by bacteria when carbon storage is necessary. More specifically this method describes using poly(3-hydroxyalkanoate) (PHAs) and their monomers as a starting material for further processing into a combustible fuel. A common source of these PHAs are bacteria that can be found in waste-water treatment plants (WWTP) effluent streams. Another source of bacteria containing PHAs are in the fermentation of distiller's grains and other low value agricultural wastes. In both WWTPs and in fermentation of distiller's grains and other low value agricultural wastes bacteria undergo a metabolic shift to store carbon using available effluent streams. The PHA compounds produced during carbon storage can be further processed using esterification and/or transesterification techniques to produce a mixture of individual carbon compounds in the range of C6 to C12. These compounds can then be purified to produce a fuel of sufficient purity for combustion.

The fuel, formed from poly(3-hydroxyalkanoate) (PHA) compounds, described in this invention has chemical properties that suggest a much cleaner combustion than current fuels. The presence of oxygen in the compounds will lower the amount of particulates in the post-combustion exhaust gas as compared to most current automotive fuels. The heat of combustion using this fuel will also be lower than most current fuels, thus creating lower NOx levels when compared to most current combustible fuels. This fuel also can be derived from many large scale renewable sources.

DETAILED DESCRIPTION OF THE INVENTION

The fuel as described can be produced using much existing infrastructure at a WWTP. Influent entering a WWTP will typically undergo a cycling of anaerobic and aerobic digestion aimed at reducing chemical oxygen demand (COD) and biological oxygen demand (BOD). During this cycling PHA accumulation may occur in bacteria due to nutrient limitation and excess carbon. Typical WWTPs are capable of producing PHAs up to, but not limited to, 4 g PHA per 100 g wet slurry. This PHA stream may contain both monomeric and polymer PHA compounds. This slurry must then be dehydrated before further processing can occur.

Dehydration can be done using either solvent extraction, physical compression or by heating. Once the hydration content is reduced to less than 5% w/w the slurry can be further processed.

In one aspect after dehydration the resulting biomass is then resuspended in an excess alcohol solution comprising ethanol at a ratio of 3.67 kg of ethanol for every kilogram of PHA.

In another aspect after dehydration the resulting biomass is then resuspended in an excess alcohol solution comprising alcohol from a selection consisting of methanol, propanol, and butanol at a ratio of 3.67 kg of alcohol for every kilogram of PHA.

In another aspect after dehydration the resulting biomass is then resuspended in an excess alcohol solution comprising ethanol at a molar ratio of less than 6 parts ethanol for each part PHA.

In another aspect after dehydration the resulting biomass stream is resuspended in an excess alcohol solution containing denaturants such as ketones or light petroleum distillates.

In one aspect sulfuric acid can then be added in the ratio of 0.65 g of sulfuric acid for each kilogram of PHA. The entire slurry is then heated to about 140° C. and the reaction is allowed to proceed for about 2 hours. The resulting products contain ethylated 3-hydroxyalkanoates that can then be further purified to be used as a combustible fuel.

In another aspect sulfuric acid can be added to an ethanol slurry containing PHA in the ratio of 0.65 g of sulfuric acid for each kilogram of PHA. The entire slurry can then be heated to between 60° C. and 160° C. for up to 240 mins. The resulting products contain ethylated 3-hydroxyalkanoates that can then be further purified to be used as a combustible fuel.

In another aspect sulfuric acid can be added an ethanol slurry containing PHA in the ratio of 0.65 g of sulfuric acid for each kilogram of PHA. The entire slurry can then be heated using microwave radiation to between 80° C. and 160° C. for between 1 minute and 120 minutes. The resulting products contain ethylated 3-hydroxyalkanoates that can then be further purified to be used as a combustible fuel.

In one aspect the first step of purification is done by the addition of a hexane solution to separate the fuel from the residual biosolids. The biofuel products will partition to the hexane phase.

In one aspect after extraction into the hexane solution a distillation column can be used to separate the biofuel products from the hexane and ethanol. The hexane and ethanol solutions can then be separated using a distillation column and recycled for reuse in another round of esterifications and extractions. The resultant biofuel product stream can then be further purified using another distillation column to remove any residual ethanol or hexane. The resulting biofuel mixture will be of sufficient purity for combustion.

In one aspect the resulting purified biofuel mixture will include alcohol derivatives of alkenoates, hydroxyalkanoates, alkoxyalkanoates, and high boiling point distillate fractions including hydroxy-fatty acids, and saturated as well as unsaturated fatty acids, oligomers of ethyl 3-hydroxy alkanoates, ethyl 3-ethoxy alkanoates, ethyl 3-hydroxybutyrate, and ethyl 3-ethoxybutyrate.

In another aspect the resulting purified mixture may be used as a specialty chemical instead of as a biofuel mixture. These specialty chemicals include crotonic acid ethyl ester, ethyl 3-hydroxybutyrate, and ethyl 3-ethoxybutyrate.

We claim:

1. A method of combustion comprising the following steps, dehydrating a stream containing biomass that contains PHA molecules, suspending the dehydrated PHA in an alcohol solution containing a catalyst to form a slurry, heating the slurry containing PHA until esterification occurs thereby forming products, separating the resulting products to obtain a biofuel and combusting the biofuel.

2. The method of claim 1 wherein the step of dehydrating the stream containing the biomass containing PHA comprises heating.

3. The method of claim 1 wherein the step of dehydrating the stream containing the biomass containing PHA comprises solvent extraction.

4. The method of claim 1 wherein the step of dehydrating the stream containing the biomass containing PHA comprises compression.

5. The method of claim 1 wherein the stream being dehydrated contains both PHA monomers and polymers.

6. The method of claim 1 wherein the PHA molecules comprise poly(3-hydroxybutyrate) (PHB).

7. The method of claim 1 wherein the PHA molecules comprise a copolymer of poly(3-hydroxy-butyrate and 3-hydroxyvalerate) (PHB/V).

8. The method of claim 1 wherein the PHA molecules comprise a mixture of PHB, PHB/V, and medium-chain-length poly(3-hydroxyalkanoate) (mcl-PHA).

9. The method of claim 1 wherein the alcohol solution comprises methanol.

10. The method of claim 1 wherein the alcohol solution comprises ethanol.

11. The method of claim 1 wherein the alcohol solution comprises propanol.

12. The method of claim 1 wherein the alcohol solution comprises butanol.

13. The method of claim 1 wherein the alcohol solution comprises a mixture of alcohols.

14. The method of claim 1 wherein the alcohol is denatured with ketone compounds.

15. The method of claim 1 wherein the alcohol is denatured with less than 20% ketone compounds.

16. The method of claim 1 wherein the alcohol solution includes one or more denaturants.

17. The method of claim 1 wherein the alcohol solution includes light petroleum distillates.

18. The method of claim 1 wherein the catalyst contains hydrochloric acid.

19. The method of claim 1 wherein the slurry containing PHA is heated to between 60° C. and 160° C.

20. The method of claim 1 wherein the slurry containing PHA is heated to about 140° C.

21. The method of claim 1 wherein the slurry containing PHA is heated for between 1 minute and 240 minutes.

22. The method of claim 1 wherein the slurry containing PHA is heated for about 120 minutes.

23. The method as described in claim 1 wherein the step of separating the products comprises distillation.

24. The method as described in claim 1 wherein the step of separating the products comprises centrifugation.

25. The method as described in claim 1 wherein the step of separating the products comprises solvent extraction.

26. The method as described in claim 25 wherein the solvent being used is hexane.

27. The method as described in claim 1 wherein the resulting products are a mixed liquid biofuel containing low boiling point distillate fractions including alcohol derivatives of alkenoates, hydroxyalkanoates, alkoxyalkanoates, and high boiling point distillate fraction including hydroxy-fatty acids, and saturated as well as unsaturated fatty acids.

28. The method as described in claim 27 wherein the high boiling point distillate fraction includes oligomers of ethyl 3-hydroxyalkanoates.

29. The method as described in claim 1 wherein the resulting product is a biofuel product comprising ethyl ethoxyalkanoates.

30. The method as described in claim 1 wherein the resulting product is a biofuel product comprising ethyl 3-hydroxybutyrate.

31. The method as described in claim 1 wherein the resulting product is a biofuel product comprising ethyl 3-ethoxybutyrate.

32. The method as described in claim 1 wherein the source of biomass is from fermentation at a waste water treatment plant.

33. The method as described in claim 1 wherein the source of biomass is from fermentation of distiller's grains.

34. The method as described in claim 1 wherein the source of biomass is from fermentation of agricultural wastes.

35. The method as described in claim 1 wherein the step of heating the slurry containing PHA is done using microwave radiation.

* * * * *